United States Patent [19]

Glenn

[11] 4,262,487

[45] Apr. 21, 1981

[54] DOUBLE WALL COMBUSTION CHAMBER FOR A COMBUSTION TURBINE

[75] Inventor: Robert G. Glenn, Huntingdon Valley, Pa.

[73] Assignee: Westinghouse Electric Corp., Pittsburgh, Pa.

[21] Appl. No.: 8,317

[22] Filed: Feb. 1, 1979

[51] Int. Cl.[3] ..... F02C 7/18

[52] U.S. Cl. ..... 60/757; 60/754

[58] Field of Search ..... 60/755, 756, 757, 752, 60/754, 758, 759, 760, 39.32; 431/350, 351, 352, 353

[56] References Cited

U.S. PATENT DOCUMENTS

| | | | |
|---|---|---|---|
| 2,447,482 | 8/1948 | Arnold . | |
| 2,504,106 | 4/1950 | Berger | 60/754 |
| 2,738,993 | 3/1956 | Wilson . | |
| 3,702,058 | 11/1972 | Decorso . | |
| 4,044,186 | 8/1977 | Stangeland . | |

FOREIGN PATENT DOCUMENTS

| | | | |
|---|---|---|---|
| 578764 | 7/1946 | United Kingdom | 60/754 |

*Primary Examiner*—Robert E. Garrett
*Attorney, Agent, or Firm*—E. F. Possessky

[57] ABSTRACT

This invention describes a double wall step-liner construction for a combustion chamber of a combustion turbine. The chamber is a series of concentric cylindrical segments stacked in overlapping arrangement such that the leading edge of each outer segment and the terminal edge of each inner segment are in general axial alignment so as to form a continuous double wall throughout the axial length of the step-liner configuration. Each cylindrical segment is attached at its inlet end and at its outlet end to the adjacent cylindrical segment by an annular transistion member formed of a wire mesh secured to each respective cylindrical segment with high temperature brazing. The relative thermal expansion between the inner and outer cylindrical segments (both axially and radially) is accommodated by deflection and distortion of the wire mesh transition members which also permits cooling air to enter between the overlapping segments and to be discharged therefrom into the combustion chamber with minimum interference.

3 Claims, 3 Drawing Figures

DOUBLE WALL COMBUSTION CHAMBER FOR A COMBUSTION TURBINE

BACKGROUND OF THE INVENTION

1. Field of the Invention

This invention relates to a combustion chamber for a combustion turbine and more particularly to a step-liner combustion chamber having double wall construction.

2. Description of the Prior Art

Double wall step-liner combustion chambers for combustion turbines are known and have been used in certain turbines manufactured by the assignee corporation of the present invention. Such structure is adequately shown and described in U.S. Pat. No. 3,702,058 and has the design advantage of convectively cooling the chamber by directing cooling air against the hot outer surface of the combustion chamber wall and providing film cooling by directing a layer or film of air on the inner surface of the combustion chamber wall. Although the double wall structure provides these advantages for cooling the chamber, the thermal gradient between the inner and outer walls results in relative thermal growth therein that produces stresses in the assembly that can result in early failure of the chamber. In recent years, the combustion turbine operating temperatures have been increasing, requiring ever-increasing temperatures within the combustion chamber. Such higher temperature chambers would be benefited by the efficient cooling provided by the double wall configuration but further increases to the temperature gradient and the resulting stresses would not be permissible if the chamber were assembled in the manner known in the prior art.

SUMMARY OF THE INVENTION

The present invention provides a step-liner double wall combustion chamber wherein the adjacent concentric cylindrical segments are assembled to provide an annular space therebetween with the inlet end of the outer cylindrical segment joined to the inner cylindrical segment by an annular transistion piece of wire mesh secured to the two segments by high temperature brazing; and, the discharge end of the inner cylindrical segment is likewise secured to the outer cylindrical segment by a similar annular wire mesh screen transistion member. Under conditions of relative thermal growth between the two cylindrical segments, the wire mesh will deflect or distort to accommodate either radial or axial dimensional changes between the segments.

DESCRIPTION OF THE PREFERRED EMBODIMENT

Figure 1:
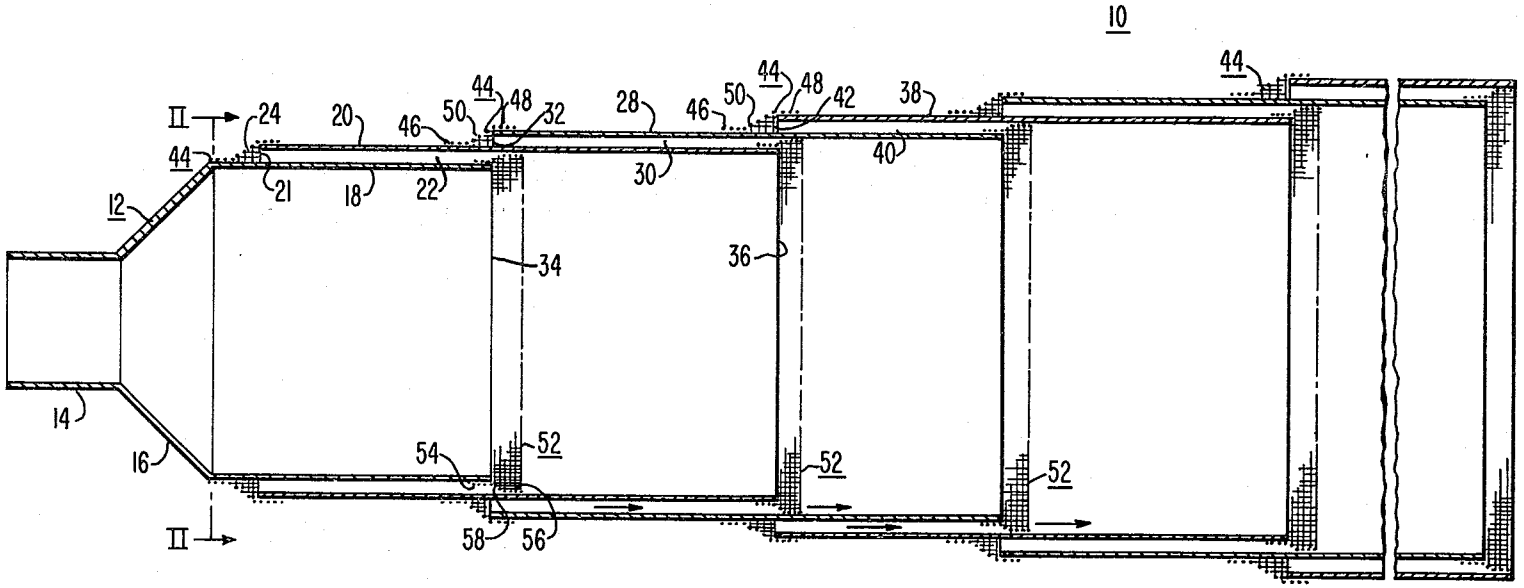
FIG. 1 is an axial cross-sectional view of the combustion chamber of the present invention.
Figure 3:
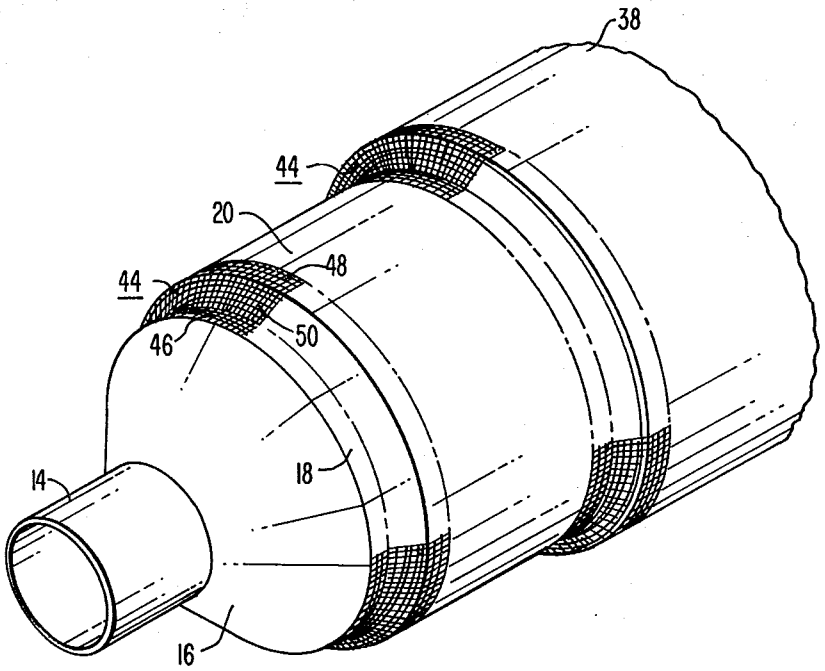
FIG. 3 is an isometric view of the combustion chamber.
Figure 2:
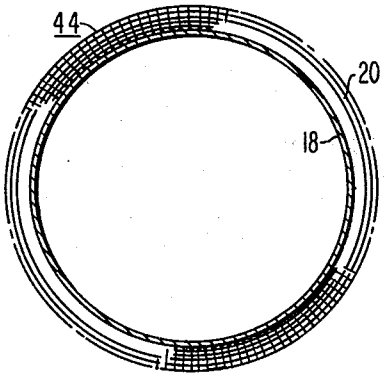
FIG. 2 is a cross-sectional view along line II-II of FIG. 1.

Referring to the Figures, the combustion chamber 10 of the present invention is seen to include an inlet section 12 comprising a cylindrical collar 14 and an outwardly tapering transition portion 16. The inlet section terminates in an axially extending first cylindrical segment 18 forming the initial inner wall of the combustion chamber 10. A second concentric cylindrical segment

20 encircles the segment 18 in spaced relation defining an annular space 22 therebetween. The initial edge 21 of segment 20 is disposed generally closely adjacent the beginning of segment 18 except for providing sufficient area thereon to mount the supporting transition wire mesh 24 as subsequently described.

The cylindrical segment 20 extends axially downstream beyond the terminal edge 26 of segment 18; however, another concentic cylindrical segment 28 encircles segment 20 in spaced relation to define therebetween a space 30 similar to space 22. Also, it will be noted that the inlet edge 32 of segment 28 is in axial alignment with the terminal or outlet edge 34 of segment 18. Thus, annular space 22 terminates axially where annular space 30 begins.

It is apparent that at the termination of segment 18, cylindrical segment 20 becomes the inner cylinder and cylindrical segment 28 the outer cylinder with segment 28 in turn extending axially beyond the terminal end 36 of segment 20. As before, another concentric cylindrical segment 38 encircles that portion of segment 28 extending beyond edge 36 and in spaced relation thereto to define another annular passage 40. Such structure is typical throughout the axial extent of the step-liner configuration to define a continuous double wall configuration providing annular cooling air inlet passages 22, 30, 40. The air flowing through such passages initially convectively cools the outer surface of the inner segment and also flows along the inner surface of the next adjacent segment to provide a film of cooling air therefor. It is also apparent that the inner wall of the combustion chamber, being exposed to radiation and hot gases of the combustion process, will be substantially warmer than the outer wall portions resulting in relative thermal growth both radially and axially therebetween.

To secure the inlet ends, 21, 32, 42 of each respective outer cylindrical segment to the cylindrical segment that each such outer segment encircles, an annular outer transition piece 44 is provided. Each outer transition piece 44 comprises an integral wire mesh configured to have a cylindrical portion 46 in facing engagement with the inner cylinder and a cylindrical portion 48 in facing engagement with the outer cylinder and an outwardly angled portion 50 extending therebetween. Each cylindrical portion 46, 48 is brazed to the facing portion of the cylindrical segments of the chamber with a high temperature brazing.

Further, it is noted that an inner transition piece 52 likewise formed of a wire mesh is secured between each terminal end of each cylindrical segment 34, 36 and the inner wall of the next adjacent cylindrical segment to maintain the terminal ends in the assembled concentric relationship. Again, the inner transition piece 52 includes a cylindrical portion 54 brazed to an area adjacent the terminal end and another cylindrical portion 56 brazed to the inner face of the next cylindrical segment and an outwardly angled portion 58 extending therebetween. Such inner and outer transition pieces are typical for supporting each inlet edge and each outlet edge, respectively, of the step-liner combustion chamber. The nature of the wire mesh is such as to accommodate the relative thermal growth, between the thus connected segments, both axially and radially by simple deformation and distortion. This thermal growth is further assisted by the angular orientation of the midportion of the transition pieces so that simple angular deformation is available. Further, the wire mesh permits cooling air to enter the annular passages 22, 30, 40 between the cylindrical segments and to be discharged therefrom with minimal interference and with a generally even distribution thereof without causing any blind or dead spots in the cooling flow path.

I claim:

1. A combustion chamber for a combustion turbine engine, said chamber defining a generally cylindrical configuration having an inlet end and an opposed discharge end and a portion intermediate the opposed ends defining a double-walled configuration comprising a plurality of individual axially extending serially arranged cylindrical segments with the adjacent segment downstream from any one segment having a greater diameter than said one segment and axially overlapping said one segment to define an annular axially extending gap therebetween providing an airflow path into said chamber and wherein the initial edge of said downstream segment is generally axially aligned with the terminal edge of the adjacent segment upstream from said one segment; and a first annular connecting member for securing said downstream segment to said one segment adjacent said initial edge; and a second annular connecting member for securing said upstream segment to said one segment adjacent said terminal edge;

said first and second annular connecting members each comprising a wire mesh.

2. Combustion structure according to claim 1 wherein said annular connecting members comprise a unitary structure defining a first generally continuous circular portion and a second generally continuous circular portion of greater diameter than said first portion and an outwardly tapered transition portion extending therebetween, and wherein said circular portions provide facing engagement with said segments for attachment thereto.

3. Combustion structure according to claim 2 wherein said circular portions of said annular connecting members are brazed to said segments.

* * * * *